US008991649B2

(12) United States Patent
Wegelin et al.

(10) Patent No.: US 8,991,649 B2
(45) Date of Patent: Mar. 31, 2015

(54) KEYED DISPENSING SYSTEMS AND RELATED METHODS

(75) Inventors: Jackson Wegelin, Stow, OH (US); Christopher Cole, Stow, OH (US)

(73) Assignee: Gojo Industries, Inc., Akron, OH (US)

( * ) Notice: Subject to any disclaimer, the term of this patent is extended or adjusted under 35 U.S.C. 154(b) by 174 days.

(21) Appl. No.: 13/343,893

(22) Filed: Jan. 5, 2012

(65) Prior Publication Data

US 2013/0175291 A1 Jul. 11, 2013

(51) Int. Cl.

| | |
|---|---|
| ***B67D 7/06*** | (2010.01) |
| ***B67D 7/00*** | (2010.01) |
| ***B65D 88/54*** | (2006.01) |
| ***B67D 7/22*** | (2010.01) |
| ***A47K 5/12*** | (2006.01) |

(52) U.S. Cl.

CPC ..... *A47K 5/1207* (2013.01); *A47K 5/1217* (2013.01)

USPC ..... 222/23; 222/325; 222/1; 222/47

(58) Field of Classification Search

USPC ..... 222/1, 14, 23, 52, 63, 181.1, 181.2, 222/181.3, 321.1, 321.7, 333, 504.325, 222/402.1, 325, 41, 47, 48

See application file for complete search history.

(56) References Cited

U.S. PATENT DOCUMENTS

| | | | | |
|---|---|---|---|---|
| 5,605,251 | A | 2/1997 | Retti | 222/1 |
| 6,431,400 | B1 | 8/2002 | O'Maley et al. | 222/41 |
| 6,739,479 | B2 | 5/2004 | Contadini et al. | 222/52 |
| 7,232,209 | B2 | 6/2007 | Asauchi | 347/86 |
| 7,621,426 | B2 * | 11/2009 | Reynolds et al. | 222/325 |
| 7,659,824 | B2 | 2/2010 | Prodanovich et al. | 340/573.1 |
| 7,837,066 | B2 | 11/2010 | Reynolds et al. | 222/52 |
| 7,940,073 | B1 | 5/2011 | Stewart | 326/8 |
| 2009/0008408 | A1 | 1/2009 | Ophardt et al. | 222/1 |
| 2009/0127282 | A1 * | 5/2009 | Reynolds et al. | 222/23 |
| 2009/0180905 | A1 | 7/2009 | Kueck et al. | 417/510 |
| 2009/0204256 | A1 | 8/2009 | Wegelin | 700/244 |
| 2009/0314800 | A1 * | 12/2009 | Reynolds et al. | 222/23 |
| 2010/0163573 | A1 | 7/2010 | Wegelin et al. | 222/1 |
| 2011/0108578 | A1 * | 5/2011 | Wegelin et al. | 222/181.3 |
| 2011/0278322 | A1 | 11/2011 | Reynolds et al. | B67D 7/05 |

FOREIGN PATENT DOCUMENTS

| | | | |
|---|---|---|---|
| CN | 201683813 | 12/2010 | A47K 5/13 |

OTHER PUBLICATIONS

International Search Report mailed Jan. 21, 2014 in corresponding application No. PCT/US2013/020194.

Written Opinion mailed Jan. 21, 2014 in corresponding application No. PCT/US2013/020194.

* cited by examiner

*Primary Examiner* — Kevin P Shaver
*Assistant Examiner* — Stephanie E Williams
(74) *Attorney, Agent, or Firm* — Renner Kenner Greive Bobak Taylor & Weber

(57) ABSTRACT

A dispensing system includes a housing and a refill container carrying a dispensable material and received in the housing. A pump mechanism is coupled to the refill container and movable from a first position to a second position and back to the first position. An identifier is carried by either the refill container or the pump mechanism, and a detection device is carried by the housing. The detection device monitors a status of the identifier and allows operation of the pump mechanism based on a status change of the identifier.

29 Claims, 3 Drawing Sheets

KEYED DISPENSING SYSTEMS AND RELATED METHODS

TECHNICAL FIELD

The present invention is generally directed to dispensing systems. In particular, the present invention is directed to keyed dispensers which allow only designated refill containers with dispensable material to be installed therein and, if desired, installed by selected distributors. More specifically, the present invention is directed to electronically keyed fluid dispensing systems.

BACKGROUND ART

It is well known to provide fluid dispensers for use in restaurants, factories, hospitals, bathrooms and the home. These dispensers may contain fluids such as soap, anti-bacterial cleansers, disinfectants, lotions and the like. It is also known to provide dispensers with some type of pump actuation mechanism wherein the user pushes or pulls a lever to dispense a quantity of fluid into the user's hands. "Hands-free" dispensers may also be utilized wherein the user simply places their hand underneath a sensor and a quantity of fluid is dispensed. Related types of dispensers may be used to dispense powder or aerosol materials.

Dispensers may directly hold a quantity of fluid, but these have been found to be messy and difficult to service. As such, it is known to use refill bags or containers that hold a quantity of fluid and provide a pump and nozzle mechanism. These refill bags are advantageous in that they are easily installed into a dispenser without a mess. And the dispenser can monitor usage to indicate when the refill bag is low and provide other dispenser status information.

Manufacturers of these fluid materials enlist distributors to install the dispensers at various locations and place the manufacturer's products in the dispensers. Further, the manufacturers rely on the distributors to put the correct refill container in the dispenser housing. For example, it would be very upsetting to hospital personnel to have hand moisturizing lotion dispensed when they instead desire anti-bacterial soap. Therefore, manufacturers provide keyed nozzle and pump mechanisms for each type of fluid refill bag so that only appropriate refill bags are installed in corresponding fluid dispensers.

Distributors prefer such a keying system so that their dispensers can only be refilled by them instead of their competitors. Replacement of refill containers by unauthorized distributors is sometimes referred to as "stuffing." In addition to providing keying between the dispenser and the fluid refill bag to ensure the compatibility of the product with the dispenser, keying is used to ensure that competitors of the distributor do not obtain the distributor's business. And it is also critical to the manufacturer that competitors do not stuff their product into the manufacturer's dispensers. Such activity prevents the manufacturer from obtaining an adequate financial return on the dispensers which are typically sold at cost or less.

Although mechanical keys are helpful in ensuring that the proper refill bag is installed into the proper dispenser and that the distributors maintain their business clientele, these keying systems have been found to be lacking. For example, if a distributor's competitor cannot install their refill packages into the distributor's dispenser device, the competitor may remove or alter the keying mechanism. As such, inferior fluid may be installed into a particular dispenser and the preferred distributor will lose sales. Mechanical keying also necessitates significant tooling costs underwritten by the manufacturer to design special nozzles and dispensers that are compatible with one another. In other words, each dispenser must be keyed for a particular product, a particular distributor and perhaps even a particular location. Accordingly, the inventory costs for maintaining refill bags with a particular key is significant. And the lead time for manufacturing such a refill bag may be quite lengthy. Moreover, the particular identification of a particular keying device may be lost or damaged so that it is difficult to determine which type of keying configuration is needed for the refill bags.

One attempt at controlling the type of product associated with a dispenser is disclosed in U.S. Pat. No. 6,431,400 B1. This patent discloses a refill bag that utilizes a wafer with an embedded magnet that must be properly oriented into a housing in order for the magnet to be detected and effectively close an on/off switch. If the magnet is not detected then the dispenser is disabled. Although effective in its' stated purpose, the device disclosed in the patent is lacking in that a specific orientation is required for installation of the refill container. The patent also discloses the use of a spiral coil on a printed circuit wafer on the bag which is inductively coupled to a similar spiral coil on the housing's base supporting surface. A capacitor connected to the spiral coil on the bag establishes a resonant frequency for a conventional frequency-measuring circuit to provide identification. It is believed that this scheme is lacking in that it provides no teaching for adaptability for use with multiple dispensers. It is also believed that the disclosed configuration is subject to a mis-alignment of the coils which may lead to mis-identification of the bag. And the use of a single coil as the emitting and receiving coils may lead to mis-identification of the bag.

Another approach to the "stuffing" problem is to provide a wire coil wrapped around a neck of a refill container, wherein a capacitor is attached to the coil to serve as an identifier key. The dispensing system that receives the refill container includes a pair of similar sized spaced apart wire coils connected to a controller which maintains a matching key. The controller energizes the first coil which in turn generates a signal detected by the refill container's coil. Together the connected coil and capacitor generate a signal detected by the other coil connected to the controller. The controller then compares the detected signal to the matching key. If there is a match, then the dispenser is enabled. If there is not a match, then the dispenser is disabled. Although this approach is effective, the wire coils must be specially manufactured and are costly. Another drawback is the added power requirements to energize the first coil and detect output of the container's coil with the other coil. Finally, this configuration is unable to provide information related to a position of the refill container's pumping mechanism during a dispensing event.

Therefore, there is a need in the art for a dispensing system that utilizes low cost components so as to provide electronic keying to prevent "stuffing." And there is a need to inexpensively provide a stroke position of the pumping mechanism as part of the electronic keying while utilizing minimal power.

SUMMARY OF THE INVENTION

In view of the foregoing it is a first aspect of the present invention to provide keyed dispensing systems and related methods.

Another aspect of the present invention is to provide a refill container for receipt in a dispensing system, the container comprising an enclosure for carrying dispensable material, a pump mechanism coupled to the enclosure and movable from a first position to a second position and back to the first position, and an identifier carried by the pump mechanism and movable between the first and second positions.

Still another aspect of the present invention is to provide a dispensing system comprising a housing, a refill container carrying a dispensable material and received in the housing, a pump mechanism coupled to the refill container and movable from a first position to a second position and back to the first position, an identifier carried by either the refill container or the pump mechanism, and a detection device carried by the housing, the detection device monitoring a status of the identifier and allowing operation of the pump mechanism based on a status change of the identifier.

Yet another aspect of the present invention is to provide a method for operating a keyed fluid dispenser, comprising installing a refill container with an identifier into a housing, detecting the presence and validity of the identifier with a detection device and setting a count value, deactivating the identifier with the detection device, and disabling an actuating mechanism if the identifier is not present or the count value is reached.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
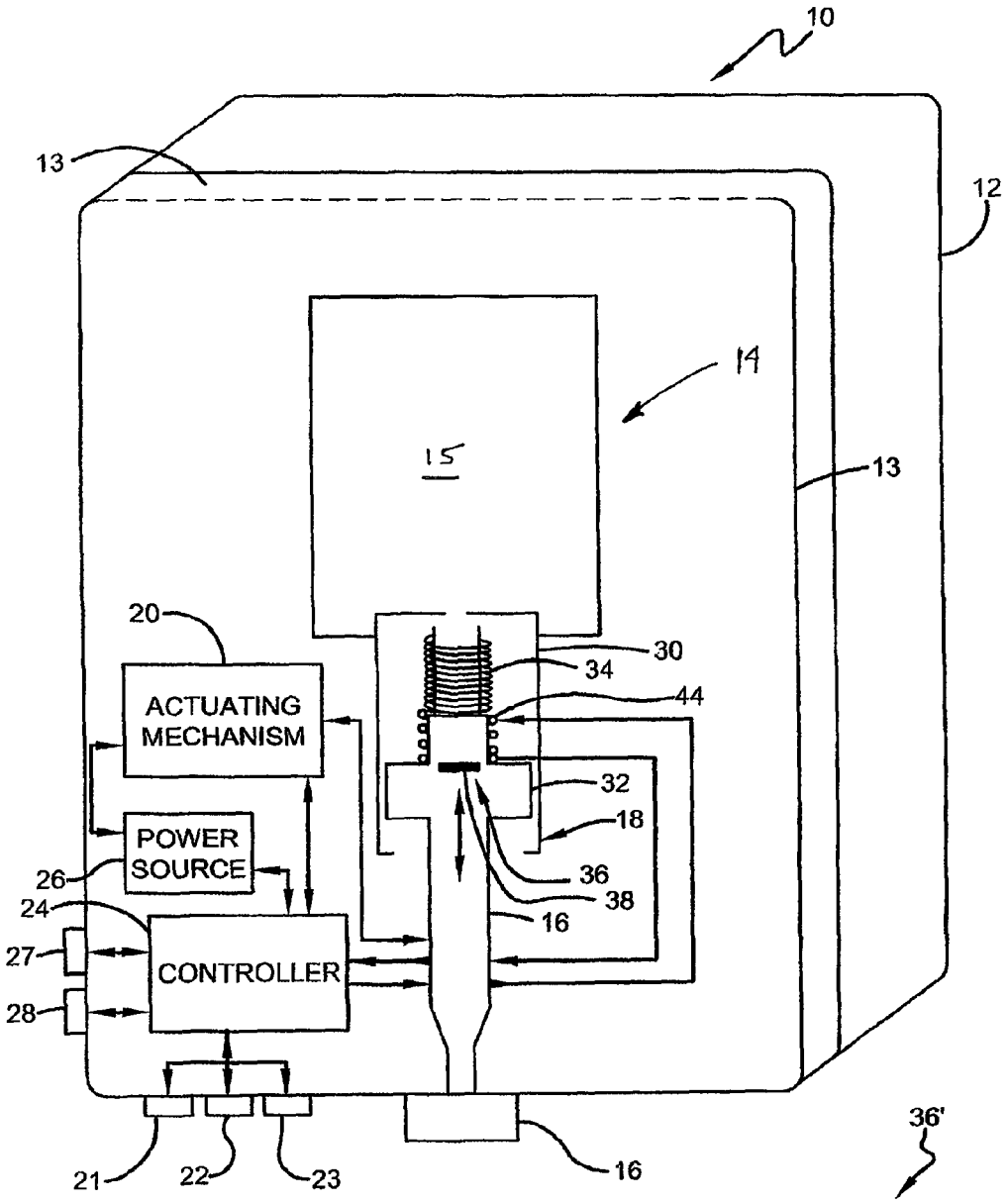
FIG. 1 is a schematic diagram of a keyed fluid dispenser made in accordance with the concepts of the present invention.

Referring now to the drawings and in particular to FIG. 1 it can be seen that a fluid dispenser made in accordance with the concepts of the present invention is designated generally by the numeral 10. The concepts of the present invention may be directed to either a touch-free or hands-free dispenser, or a hand-actuated manual dispenser. Moreover, skilled artisans will appreciate that the present invention may also be utilized in any dispensing device which is battery operated or uses power from a source or conventional mains power to power at least one electrical component. In any event, the dispenser 10 includes a housing 12 which provides a cover or door 13 that when open allows a technician to install or replace a refill container 14. The container 14, includes a cartridge, a bag, or an enclosure 15 which contains a fluid material such as a soap, a sanitizer or other material that is dispensed in measured amounts. Associated with the refill container 14 is a nozzle 16 which is a conduit from the enclosure 15 to an object receiving the fluid such as a user's hands or any other object upon which the fluid is dispensed. As used herein, the term "user" refers to a person or object detected by the dispenser so as to initiate a dispensing cycle. In other words, in hands-free embodiments, the dispenser detects the presence of a user or an object in close proximity to where the fluid material is dispensed and the dispenser determines that the user or object intends to receive the fluid. It will further be appreciated that a user may be a single person, or object who actuates the dispenser once or repeatedly, or multiple users or objects that are detected, one after the other. As such, a "second" user may in fact be the first user. In any event, the dispenser 10 includes a pump mechanism 18 which is interposed between the container 14 and the nozzle 16. The mechanism 18 is coupled to an actuating mechanism 20 which may be a motorized mechanism or solenoid that actuates the pump mechanism, or a manually-actuated push bar lever.

A proximity sensor 21 may be associated with the housing 12 and may be in the form of an infrared, sonic (ultrasonic and subsonic), or capacitive type sensor which detects the presence of an object or the user's hands for use in a hands-free embodiment. In some embodiments, an ambient light sensor 22 and/or a motion detection sensor 23 are carried by the housing 12. These sensors can be used to assist in the operation and control of the dispenser.

A controller 24 is carried by the housing and is connected to the proximity sensor 21, the ambient light sensor 22, the motion detector 23, the actuating mechanism 20 and in some embodiments, the pump mechanism 18. A power source 26 provides electrical power to the sensors 21, 22 and 23 via the controller 24; the controller 24; the pump mechanism 18 if required; and the actuating mechanism 20. The power source 26 includes one or more batteries, which may be referred to as cells throughout the specification. The batteries used for the power source may be recharged by solar cells or by other means.

In some embodiments, the controller 24 may also be connected to an indicator 27 and a wireless communication device 28. Both the indicator 27 and the device 28 may be powered by the power source 26 directly through the controller 24. The indicator 27 may be used to visually, audibly or otherwise convey to the user or maintenance staff a status of the dispenser 10 and in particular a status of selected components within the dispenser. The status may also be transmitted by the controller 24 through the wireless communication device 28 to a network that monitors the dispenser, to another dispenser in a mesh network made up of other dispensers and/or appliances, or to a remote indicator.

The pump mechanism 18 includes a collar 30 that is secured in a standard fashion to an opening provided by the enclosure 15. As such, the collar 30 is fixed to the enclosure 15. The pump mechanism 18 further includes a movable plunger 32 that is carried by the collar 30. Extending from the plunger 32 is the nozzle 16 which may be a separate component or included as part of the plunger 32. A spring 32 is coupled to the plunger 32 and biases the plunger to a closed position. In other words, the spring 34 forcibly keeps the plunger 32 in a closed position so as to prevent fluid from exiting through the nozzle. The actuating mechanism 20 is configured so as to be coupled to the plunger 32 and exerts a force to overcome the biasing forces of the spring 34 and move the plunger into an open position and allow for the dispensing of fluid from the enclosure 15.

Figure 1A:
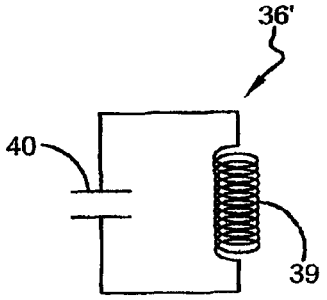
FIG. 1A is a schematic diagram of an alternative embodiment used in the keyed fluid dispenser according to the concepts of the present invention.

The plunger 32 carries an identifier designated generally by the numeral 36. The identifier 36 moves with the plunger whenever actuated by the actuating mechanism 20 and returns as the plunger 32 returns when the spring bias forces of the spring 34 overcome the actuating mechanism forces or when the actuating forces are released. In the present embodiment, the identifier 36 may comprise a medium such as a ferrite bead or beads, a magnet, an optically reflective substance, a tank circuit or the like. In one embodiment a single ferrite bead 38 is utilized and maintained within the plunger 32 and the bead is configured so as to not come in contact with any of the fluid material maintained by the enclosure. The identifier 36 may be modified such that different types and/or amounts of ferrite material are part of the ferrite bead or beads. For example, two smaller ferrite beads of one ferrite material may provide the same signal response as a single bead of a different ferrite material that is not necessarily the same equivalent size as the two smaller beads. In another embodiment, an identifier 36' is in the form of a tank circuit as shown in FIG. 1A. The identifier—tank circuit 36' includes a coil 39 with a capacitor 40 connected in parallel across the coil 39. As with the ferrite bead/beads embodiment, no power is supplied directly to the tank circuit. The tank circuit resonates when placed in a time-variant electromagnetic field, and resonated with a much higher voltage (an oscillating current between the two components) as the frequency of the electromagnetic field gets closer to the resonant frequency of the tank circuit.

A detection device 44 is placed in proximity to the plunger 32 and typically carried by the collar 30. The detection device 44 is connected to the controller 24 and is configured so as to read or observe the position of the identifier 36. In the present embodiment the detection device is an air coil connected to the controller wherein movement of the ferrite bead 38 or other medium is detected by the air coil and this detection of position and/or change of position is communicated to the controller 24. For the embodiment that uses the tank circuit, the position of the identifier 36' can be determined by keeping the electromagnetic field of the detection device—air coil—at a constant frequency and measuring the voltage across the detection device which is emitting the electromagnetic energy. As the coil in the tank circuit gets closer to the middle of the encompassing air coil, the coil 39 absorbs more energy, resulting in a lower voltage across the air coil. This change in the voltage value is detected by the controller 24 which adjusts operation of the mechanism 20 accordingly.

In operation, the identifier 36 is placed on or otherwise carried by the plunger 32 which is maintained inside or within the air coil or detection device 44. The controller 24 excites or energizes the air coil 44 at a constant frequency, such as two kHz, and the output detected by the coil is rectified and the associated voltage level is measured by the controller. When an identifier such as a ferrite material is present, an inductance value of the air coil is changed such that a corresponding detected voltage level changes. In other words, as the ferrite material changes position inside the cavity formed by the detector coil 44 the magnetic permeability of the core of the coil changes, which in turn, changes the inductance of the coil. Likewise, the resonance of the detector coil changes as its inductance changes, and this change is detected and measured by the controller. If more ferrite material, such as multiple beads 38 are added, the detected voltage level changes proportionally to the number of ferrite beads in the field generated by the air coil. As the ferrite material, bead or beads 38 move within the pump mechanism 18 during the dispensing cycle, the voltage level changes depending on the instantaneous position of the ferrite bead in the field generated by the coil, thus providing position information as well. Accordingly, if the controller 24 does not detect the presence of the ferrite identifier 36 when an actuation event is detected, then the controller stops the dispensing event by disabling the actuating mechanism and use of the dispensing mechanism stops.

The controller 24 can be configured to detect the presence of a ferrite material by the air coil, or the controller can be further refined to detect a specific voltage value, which may be associated with a specific number of ferrite beads or a particular type of ferrite material. In this manner, a different number of ferrite beads can be used as a keying mechanism so as to ensure that a proper refill container is being used with an appropriate dispenser. For example, the controller for each dispenser may be pre-programmed at the factory or modified at installation to look for a specific signal from the detection device 44. As such, if the detection device 44 with the controller 24 only detects the presence of one ferrite bead when two beads should be observed, then the controller 24 disables or otherwise deactivates the actuating mechanism and the dispensing cycle. As a result, any number of keys could be developed for any corresponding number of fluid types. Accordingly, a "key" can be selected based on the number of beads 38, the composition of the ferrite material used in the beads, other physical characteristics, and/or any combination of the foregoing that could be used as an identifier. Of course, other mediums could be used in place of the ferrite beads, such as an optically reflective material which is detectable by an appropriate sensor. In other words, use of the medium on the movable component of the dispensing mechanism allows for a clear indication of the presence of a proper refill container.

The use of the ferrite bead or beads as the identifier can provide for position information regarding the plunger 32 position in relation to the collar 30. Accordingly, this feature can be utilized as an end of stroke switch or threshold so that the pumping mechanism 18 can be stopped by the actuating mechanism 20 at the appropriate time. By accurately determining the position of the plunger, the controller 24 and the actuating mechanism 20 can precisely control the dispensing cycle and a savings in the amount of fluid being dispensed.

Another method of obtaining the position of the ferrite would be to sweep across a range of frequencies and measure the voltage across the coil 34 across this range. Because the resonant frequency of the emitter coil 34 changes as the position of the ferrite identifier changes, so will the resonant frequency. This shift in resonant frequency indicates the shift in position of the ferrite. So, in summary, position of the plunger 32 can be determined by either relating the rectified emitter coil voltage to the ferrite position, or by relating the resonant frequency of the emitter coil and ferrite combination to the ferrite's position.

This embodiment is advantageous in that the modification to the pump mechanism and the dispenser is of low cost. In other words, the use of an air coil as a detection device and the ferrite bead or beads or other device as the identifier medium is of minimal cost. This configuration also allows for multiple keys to be utilized by utilizing one or more than one ferrite bead. Such a dispenser configuration is also "sustainable" in that no copper is utilized in the cartridge and that the magnetic material can easily be removed from the recycling stream. The detection circuit utilized is also of low cost and, as noted previously, it can replace an end of stroke switch in a dispenser.

Figure 2:
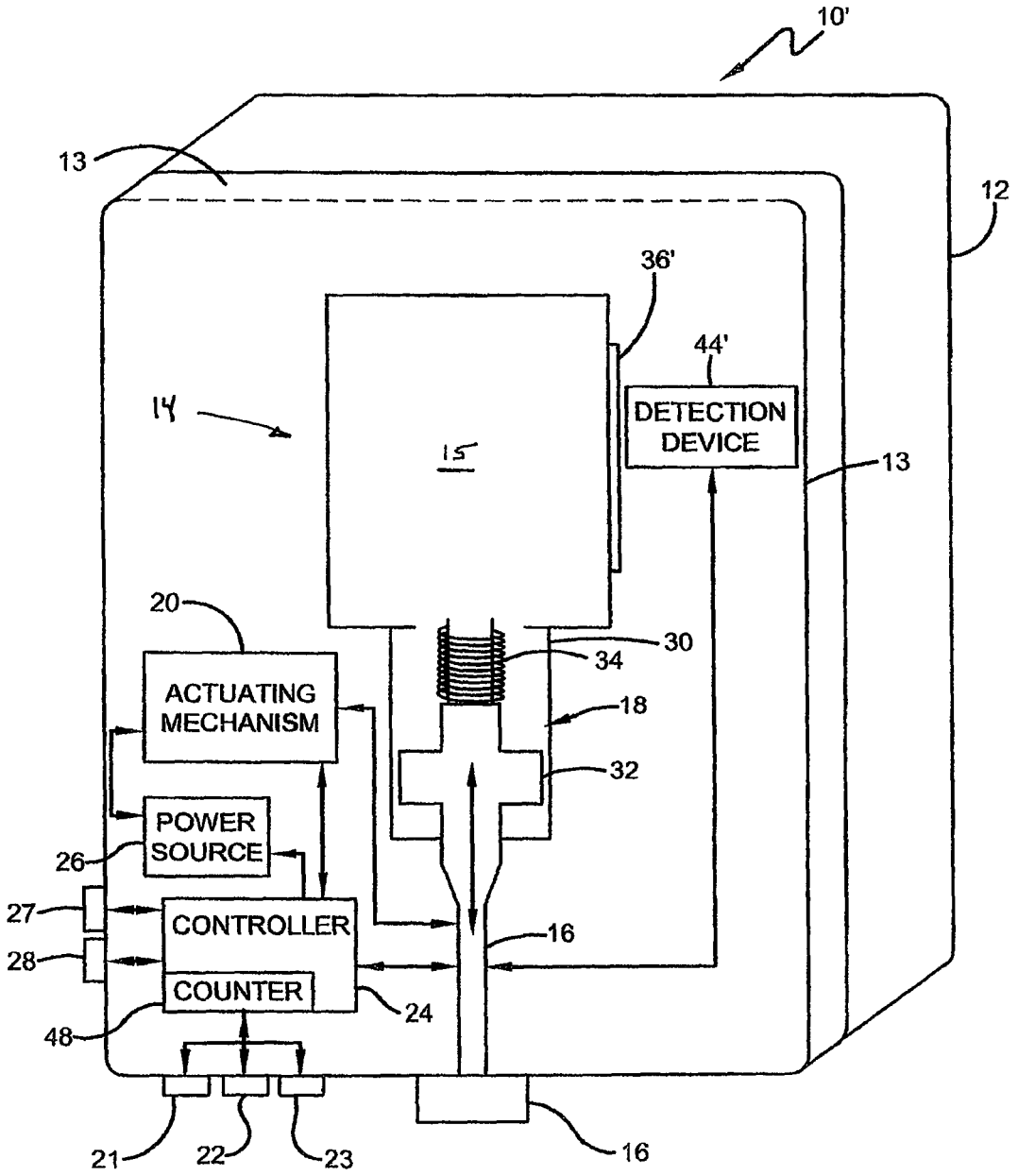
FIG. 2 is a schematic diagram of an alternative keyed fluid dispenser made in accordance with the concepts of the present invention.

Referring now to FIG. 2, it can be seen that an alternative embodiment dispenser is designated generally by the numeral 10'. This embodiment utilizes many of the same components as in the previous embodiment, but with a slightly different configuration of a medium and a detection device. In this embodiment, the dispenser 10' includes an identifier 36' that is secured to the refill container 14. In the present embodiment, the identifier 36' is a radio frequency identification device configured as an 8.2 MHz electronic article surveillance tag which is placed on the surface of the refill container 14. A detection device 44', which in this present embodiment is an air coil, is placed near the identifier 36' and a range of frequencies from below 8.2 MHz to above 8.2 MHz are generated by the controller together with the detection device 44'.

Of course, any other appropriate range of frequencies could be used. After application of the designated frequency is detected, the output of the air coil is the rectified and measured by the controller. If the controller detects a significant "dip" in the voltage, a tag is known to be present. This detection method is sometimes referred to as a "grid dip" oscillator.

Associated with the controller 24 is a counter 48 which is reset each time a new refill container is detected. In other words, each time a new container is inserted into the dispenser housing a count value is set at the counter 48 to a predetermined value such as zero. Next, after a refill container is validated, the counter allows the certain number of dispense events to occur by either counting up to a predetermined value or counting down to zero without requiring detection of a new identifier. After validation, the controller then deactivates the RFID identifier 36' by utilizing a frequency sweep to determine the exact resonant frequency of the tag and then transmitting the frequency at a high power level. This degrades the dielectric material in the identifier 36' and shifts its resonant frequency out of the detection band. In other words, the identifier 36' is deactivated so that it is no longer detectable. Next, the controller then begins counting up or down the number of uses of the dispenser as they occur which can be associated with the amount of material in the fluid container 14. When the count reaches the predetermined value or zero, then the actuating mechanism is rendered inoperative and this serves as an indication that the refill container must be replaced. Some type of notice by the indicator 27 and/or the wireless communication device 28 may convey the operational status of the dispenser.

Figure 3:
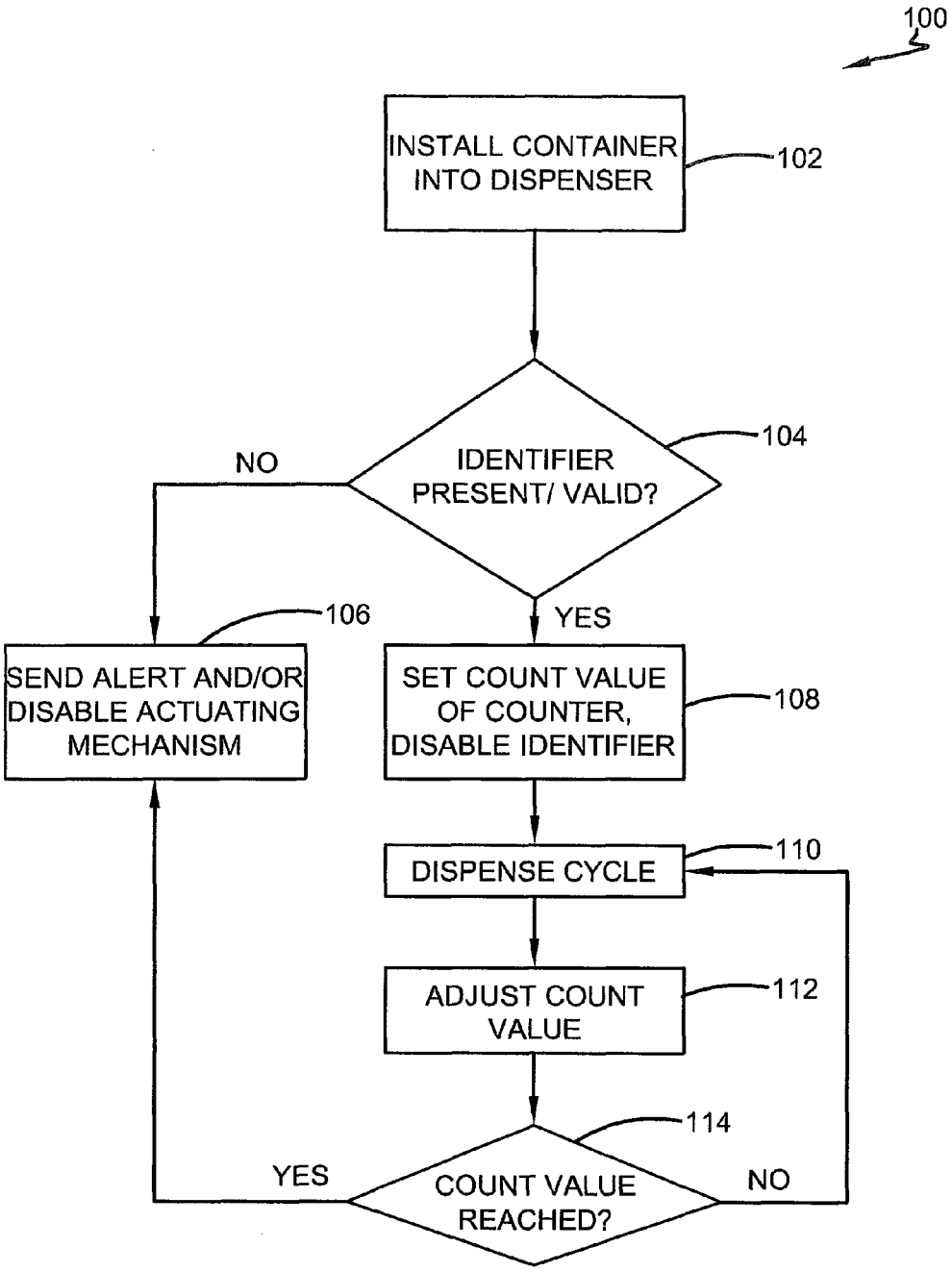
FIG. 3 is an operational flow chart utilized by the alternative keyed fluid dispenser in accordance with the concepts of the present invention.

To clearly set out operation of the dispenser 10, reference is made to FIG. 3, which shows a method of operation designated generally by the numeral 100. At step 102, the container 14 is installed into the dispenser housing 12 and the cover 13 is closed. At step 104 the controller 24 energizes the detection device 44' at the appropriate frequency and transmits a return output signal back to the controller 24 for evaluation. Then the controller determines whether the identifier 36' is present and valid. If the identifier 36' is not present, or if the identifier 36' is present, but not valid, then at step 106 the actuating mechanism 20 is disabled by the controller 24 or otherwise so as to prevent dispensing of any material from the container. Alternatively at step 106, the controller 24 can signal the indicator 26 and/or enable the wireless communication device 27 to display or send an indication or status to the user or maintenance staff that the count value has been reached and that the container is ready for replacement. It will be appreciated that both disablement of the mechanism and sending of a notice can take place simultaneously. In any event, if the identifier 36' is present and valid at step 104, then at step 108 the controller 24 sets a count value in the counter 48, wherein the count value is the number of dispense cycles associated with the material carried by the container. At about the same time the count value is set, the controller 24 deactivates the detection device as described previously.

At step 110, the dispenser undergoes a dispense cycle upon action by the user and at step 112 the controller 24 adjusts the count value accordingly. Finally, at step 114 the controller 24 determines whether the count value has been reached or not. If the predetermined count value has not been reached, then the method returns to step 110. However, if the count value has been reached at step 114, then the actuating mechanism 20 is disabled and/or notice is sent as set out in step 106.

This embodiment is advantageous in that an identifier or tag can be deactivated to prevent refilling of the enclosure with non-approved material. The method of implementation of this embodiment is relatively inexpensive as there are no modifications to existing refill containers and no motion detection of the pump mechanism is required.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

The invention claimed is:

1. A refill container for receipt in a dispensing system, the container comprising:

an enclosure for carrying dispensable material;

a pump mechanism coupled to said enclosure and movable from a first position to a second position and back to said first position; and a keying identifier carried by a movable portion of said pump mechanism and associated with the dispensable material, said movable portion is movable between said first and second positions so that said keying identifier provides a clear indication of a proper refill container.

2. The refill container according to claim 1, wherein said pump mechanism comprises:

a collar secured to said enclosure;

a plunger receivable in said collar; and a nozzle movable with said plunger, such that the dispensable material moves through said nozzle as said plunger moves from said first position to said second position.

3. The refill container according to claim 1, wherein said pump mechanism includes a plunger that is spring-biased to said first position.

4. The refill container according to claim 3, wherein said keying identifier comprises a medium adapted to be observed by a detection device.

5. The refill container according to claim 3, wherein said keying identifier comprises a ferrite material maintained in a fixed position on said plunger.

6. The refill container according to claim 3, wherein said keying identifier comprises at least one ferrite bead disposed about and secured to said plunger.

7. The refill container according to claim 3, wherein said keying identifier comprises a wire coil having a parallel connected capacitor.

8. A dispensing system, comprising:

a housing;

a refill container carrying a dispensable material and received in said housing;

a pump mechanism coupled to said refill container and movable from a first position to a second position and back to said first position;

an identifier carried by either said refill container or said pump mechanism; and a detection device carried by said housing, said detection device detecting movement of said identifier and allowing operation of said pump mechanism based on movement of said identifier.

9. The dispensing system according to claim 8, wherein said identifier is movable between said first position and said second position.

10. The dispensing system according to claim 9, further comprising:

a controller connected to said detecting device, said controller blocking movement of said pump mechanism if said detection device does not detect expected movement of said identifier.

11. The dispensing system according to claim 10, wherein said pump mechanism comprises:

a collar secured to said enclosure;

a plunger receivable in said collar; and a nozzle movable with said plunger, such that the dispensable material moves through said nozzle as said plunger moves from said first position to said second position.

12. The dispensing system according to claim 11, wherein said plunger is spring-biased to said first position.

13. The dispensing system according to claim 10, wherein said detection device comprises an air coil positioned in proximity to said pump mechanism, and wherein said identifier comprises a ferrite material maintained in a fixed position on a movable part of said pump mechanism, said air coil detecting a position of said movable part during a dispensing event.

14. The dispensing system according to claim 13, wherein said controller stops movement of said movable part of said pump mechanism at a predetermined position of said movable part detected by said air coil.

15. The dispensing system according to claim 10, wherein said detection device comprises an air coil positioned in proximity to said pump mechanism, and wherein said identifier comprises a wire coil having a parallel connected capacitor, said air coil detecting a position of said movable part during a dispensing event.

16. The dispensing system according to claim 15, wherein said controller stops movement of said movable part of said pump mechanism at a predetermined position of said movable part detected by said air coil.

17. A method for operating a keyed fluid dispenser, comprising:

installing a refill container with an identifier into a housing;

detecting the presence and validity of said identifier with a detection device and setting a count value;

deactivating said identifier with said detection device; and disabling an actuating mechanism if said identifier is not present or said count value is reached.

18. The method according to claim 17, further comprising:

adjusting said count value after each dispensing cycle of said actuating mechanism.

19. The refill container according to claim 1, wherein said movable identifier, with no electrical power supplied thereto, generates a detectable electrical signal.

20. A method for operating a keyed fluid dispenser, comprising:

providing a refill container with a pump mechanism that carries an identifier that moves as the pump mechanism moves between a first position and a second position when dispensing material from said refill container;

installing said refill container in a housing, said housing carrying a detection device to monitor said identifier;

actuating said pump mechanism by a user so that said identifier moves into a position observable by said detection device; and determining whether said identifier carried by said refill container is compatible with said housing and stopping movement of said pump mechanism if said identifier is not compatible.

21. The method according to claim 20, further comprising:

maintaining either a ferrite material or a wire coil connected to a capacitor in a fixed position on a movable part of said pump mechanism.

22. The method according to claim 21, further comprising:

maintaining an air coil on said housing in close proximity to said pump mechanism;

detecting movement of either said ferrite material or said wire coil connected to said capacitor by said air coil and generating a detection signal; and receiving said detection signal in a controller which determines the validity of said detection signal and then enables operation of said pump mechanism accordingly.

23. A refill container for receipt in a dispensing system, the container comprising:

an enclosure for carrying dispensable material;

a pump mechanism coupled to said enclosure and movable from a first position to a second position and back to said first position; and an identifier carried by said pump mechanism and movable between said first and second positions, wherein said identifier is selected from the group consisting of a medium adapted to be observed by a detection device, a metallic component, a ferrite material maintained in a fixed position on a plunger, at least one ferrite bead disposed about and secured to said plunger, and a wire coil having a parallel connected capacitor.

24. The refill container according to claim 23, wherein said pump mechanism comprises:

a collar secured to said enclosure;

a plunger receivable in said collar; and a nozzle movable with said plunger, such that the dispensable material moves through said nozzle as said plunger moves from said first position to said second position.

25. The refill container according to claim 24, wherein said plunger is spring-biased to said first position.

26. The refill container according to claim 1, wherein movement of said keying identifier is detectable by a non-contacting detection device.

27. The refill container according to claim 1, wherein said keying identifier is detectable by a detection device without a direct supply of power to said keying identifier.

28. The refill container according to claim 1, wherein said keying identifier is selected from the group consisting of:

a medium adapted to be observed by a detection device, a metallic component, a ferrite material maintained in a fixed position on said plunger, at least one ferrite bead disposed about and secured to said plunger, and a wire coil having a parallel connected capacitor.

29. The refill container according to claim 1, wherein said keying identifier comprises a metallic component.

* * * * *

UNITED STATES PATENT AND TRADEMARK OFFICE

CERTIFICATE OF CORRECTION

PATENT NO. : 8,991,649 B2
APPLICATION NO. : 13/343893
DATED : March 31, 2015
INVENTOR(S) : Jackson Wegelin and Christopher Cole It is certified that error appears in the above-identified patent and that said Letters Patent is hereby corrected as shown below:

In the claims

In Column 8, lines 53 and 54 (Claim 8) the clause "an identifier carried by either said refill container or said pump mechanism; and" should read --an identifier carried and moved by said pump mechanism; and--

Signed and Sealed this
Thirteenth Day of October, 2015

Michelle K. Lee

Michelle K. Lee
*Director of the United States Patent and Trademark Office*